US005795235A

United States Patent [19]

Ullrich et al.

[11] Patent Number: 5,795,235

[45] Date of Patent: Aug. 18, 1998

[54] CAROUSEL

[76] Inventors: Jürgen Ullrich, Eisbergsteige 1, 72202 Nagold, Germany; Karin Kohl, Ringstrasse 26/1, 75328 Schoemberg/Langenbrand/Wuertt., Germany

[21] Appl. No.: 682,709

[22] PCT Filed: Jan. 31, 1995

[86] PCT No.: PCT/EP95/00339

§ 371 Date: Sep. 4, 1996

§ 102(e) Date: Sep. 4, 1996

[87] PCT Pub. No.: WO95/20426

PCT Pub. Date: Aug. 3, 1995

[30] Foreign Application Priority Data

Jan. 31, 1994 [DE] Germany ..... P4402806.7

[51] Int. Cl.[6] ..... A63G 1/12

[52] U.S. Cl. ..... 472/14; 472/16

[58] Field of Search ..... 472/14, 15, 25, 472/29, 16, 35

[56] References Cited

U.S. PATENT DOCUMENTS

| | | |
|---|---|---|
| 1,733,005 | 10/1929 | Clayton . |
| 2,686,674 | 8/1954 | Behrens . |
| 2,785,896 | 3/1957 | Ellis . |
| 3,749,399 | 7/1973 | Fedor et al. . |
| 3,873,087 | 3/1975 | Burkart et al. . |
| 4,119,310 | 10/1978 | Trubody . |

FOREIGN PATENT DOCUMENTS

| | | |
|---|---|---|
| 0 498 605 A1 | 2/1992 | European Pat. Off. . |
| 2 227 029 | 11/1974 | France . |
| 4 416 | 6/1901 | Germany . |
| 910 516 | 8/1954 | Germany . |
| 6600571 | 6/1965 | Germany . |
| 1 806 045 | 10/1968 | Germany . |
| 1 941 429 | 3/1971 | Germany . |
| 2 255 315 | 11/1972 | Germany . |
| 647 521 | 12/1950 | United Kingdom . |

*Primary Examiner*—Kien T. Nguyen
*Attorney, Agent, or Firm*—Burns, Doane, Swecker & Mathis, L.L.P.

[57] ABSTRACT

The present invention relates to a carousel for people, especially children, with a substructure that is stationary relative to the ground and that has a stator axle essentially perpendicular to the ground and a radial support star essentially parallel to the ground, and with a rotor being rotatable about the stator axle and having a turning section for carrying people. To create a carousel of this type that is easy to operate and versatile and that affords adequate safety even when used improperly, the invention proposes that the radial support star should be located on a profiled ground plate in recesses thereof that essentially conform to the shape of the radial support star, and that the radial support star or ground plate has provided thereon a central centering shoulder aligned to engage in a central receiving portion provided on the respectively other member.

25 Claims, 6 Drawing Sheets

CAROUSEL

The present invention relates to a carousel for people, especially children, comprising a substructure which is stationary relative to the ground and which has a stator axle essentially perpendicular to the ground and a radial support star essentially parallel to the ground, and a rotor being rotatable about the stator axle and having a turning section for carrying people.

Carousels of this type, as are, for instance, known from German Utility Model 18 06 045, are especially known as equipment for public playgrounds for children or also from the private field. On the one hand, as far as these carousels are concerned, both proper and improper use by toddlers must be taken into account and adequate safety must be ensured. On the other hand, these carousels must be designed such that even when they are used by adolescents or adults the resulting higher loads are carried.

In the carousel described in German Utility Model 18 06 045 there is e.g. the risk that children let their legs dangle out of the rotor downwardly, hitting with their legs against the struts of the radial support star or, in the most adverse case, getting their legs jammed between the rotor struts and the struts of the radial support star.

It is the object of the present invention to provide a carousel of the above-mentioned type that is easy to operate and versatile and affords adequate safety even when used improperly.

According to the invention this object is achieved in that the radial support star is located on a profiled ground plate in recesses thereof that essentially conform to the shape of the radial support star, and that the radial support star or ground plate has provided thereon a central centering shoulder aligned to engage in a central receiving portion provided on the respectively other member.

As a result, the radial support star can be inserted substantially positively into the recesses of the ground plate. As a consequence, the radial support star no longer presents any risk of inflicting injuries. Moreover, the radial support star is secured against rotation relative to the ground plate via its positive fixation, so that the torque acting on the substructure is carried on the edges of the recesses.

The profiled shape of the base plate ensures that the forces acting on the base plate are transmitted to the ground. The profiled shape fixedly anchors the bottom side of the base plate to the ground, e.g. soil. When the ground plate is slightly immersed in the soil, the ground plate is thereby fixed virtually positively to the ground. At the same time, the ground plate increases the support surface of the substructure on the ground, which prevents the substructure from excessively sinking into a possibly wet ground.

The ground plate advantageously forms a fluid-tight seal in downward direction and protects the radial support star from getting soiled. The radial support star which is often made of metal is thus protected against corrosive action from the ground.

To be more specific, the carousel is closed in a child-proof manner by the ground plate also around the bottom portion, so that there will be no risk of injuries even when the carousel is turning around in an actually undesired manner.

When the centering shoulder is, for instance, provided on the radial support star, the central receiving portion is provided on the ground plate, and vice versa. This alignment of radial support star and ground plate via the combination of centering shoulder and centering receiving portion ensures that the ground plate is always arranged in a precise position relative to the rotating rotor. A circular ground plate can thus be arranged concentric to the rotor and stator axles. Such a centering is of special advantage to an accurate termination of the ground plate with an adjacent rotor member. Hence, the members of the rotor that are close to the ground plate are at a radially constant distance to the ground plate when the rotor rotates, thereby preventing injuries.

The centering shoulder is preferably designed as a centering bolt formed into the ground plate. As a result, the centering shoulder can be formed together with the profiling of the ground plate.

It is especially advantageous when the ground plate is made circular and is gripped over by a skirting of the turning section circumferentially at least to some extent. This creates an overlapping portion between turning section and ground plate that forms a shaped end between the rotating turning section and the stationary substructure. There is only the skirting visible to the outside, so that operators are protected from injuries between rotating and stationary parts.

The ground plate may especially be provided on the circumference with a circumferential edge oriented towards the turning section. The circumferential edge may additionally enclose the radial support star and protect the same in radial direction to the outside. Circumferential edge and skirting of the turning section jointly form a kind of labyrinth barrier which makes it impossible for users, especially children, to grip therethrough. The gap between circumferential edge and skirting is kept very small, preferably 3 mm, owing to the inventive centering of the ground plate.

It is suggested that the rotor comprise radial supports which support the turning section and which, enclosing an angle with the horizontal plane, are arranged to face upwards. Horizontal plane means here a parallel plane relative to the ground, and upwardly oriented means the direction oriented away from the ground. On account of the angled arrangement of the radial supports, the latter can be lowered downwardly to a slight degree when the rotor is loaded, for instance, occupied by people, without the radial supports colliding with the ground plate or the radial support star. The turning section is given a certain elasticity by such an angled arrangement, which has an effect on the users' comfort. Of course, a substructure, a rotor with turning section and the radial supports are required for such an angled arrangement of the radial supports.

The angle is advantageously between 1° and 50°.

The angle is expediently about 2° C.

In a preferred embodiment, the angle is dimensioned such that in the fully loaded state of the turning section the radial supports are arranged above the horizontal plane containing their respective attachment point on a rotor axle. This ensures that the radial struts will never be lowered below a specific level because of loads, so that there will be no risk of collision with the ground plate or the radial support star.

In a variant of the invention, the height of the overlapping part of the skirting corresponds at least to the height difference of the radial supports between fully loaded and unloaded rotor. This ensures that the skirting will always grip over the ground plate efficiently and independently of the loads. Hence, there is no possibility of direct engagement between skirting and ground plate.

The clearance between circumferential edge of the ground plate and the overlapping skirting in the loaded and unloaded states of the rotor is possibly not more than three millimeters. Despite the normally not very precise rotary guidance between rotor and substructure in carousels, such a small distance is possible without these two members contacting each other during turning or in the case of a unilaterally loaded turning section. The distance of three millimeters is especially advantageous for preventing any passage between ground plate and skirting.

A hand wheel is preferably provided at the upper end of the stator axle. Persons occupying the carousel may grip the hand wheel and rotate themselves together with the turning section about the stator axle and the hand wheel.

The hand wheel may comprise a surrounding edge oriented towards the ground in an especially advantageous manner. Persons can grip this edge in an excellent manner with their hands.

The surrounding edge may advantageously be provided on the circumference with indentations. This makes the hand wheel especially handy.

Particularly, the hand wheel may substantially have the shape of a crown cap. Astonishingly enough, this shape which is otherwise only suited for bottle stoppers is especially advantageous and handy from an ergonomic point of view.

In a preferred embodiment, the edge is terminated at the bottom side by a continuously surrounding circular edge. As a result, the recesses and the crown cap shape, respectively, are terminated in circular fashion, thereby also preventing injuries during turning around the hand wheel.

It is possible to interconnect the substructure and the rotor via a speed limiting means. This especially avoids improper use of the carousel due to excessive speeds. As a consequence, the structural members designed for limited load are protected on the one hand. On the other hand, the speed limiting means can be adjusted such that the maximum speed is just acceptable for small children. When the carousel is used by different persons of different ages, the rotational speed still acceptable for the weakest occupants will never be exceeded. The substructure and the rotor of the carousel are necessary for the speed limiting means.

The speed limiting means is designed as a viscous coupling in a variant of the invention. A viscous coupling is here a fluid coupling in which a fluid is stirred upon rotation of the rotor, the viscosity of the fluid increasing with an increasing stirring action and an increased resistance being offered to rotor rotation. Common viscous couplings are known from automotive engineering. A viscous coupling has turned out to be an especially efficient, space-saving and inexpensive speed limiting means which, astonishingly enough, can also be used in the carousel of the invention.

The speed limiting means is possibly coupled to the hand wheel.

The hand wheel is preferably connected via a limit torque release means to the stator axle. The limit torque release means provides for a fixed connection between hand wheel and stator axle until a limit torque is reached. When the limit torque is exceeded, the hand wheel will be rotatable relative to the stationary stator axle. This ensures that a person turning together with the turning section will not get injured when gripping the hand wheel, but the latter will turn together with the person after the limit torque has been exceeded. This prevents injuries.

The hand wheel is expediently connected by means of an adapter member to the stator axle.

In a variant of the invention, the limit torque release means includes a wedge element which expands the adapter member projecting into the stator axle at least in portions for frictional contact with the substructure. This is an especially simple, but efficient limit torque release means, the limit torque being defined by the frictional force acting between the stator axle and the adapter member.

The limit torque of the limit-torque release means can advantageously be adjusted via an adjusting device. For instance, the limit torque can be adjusted by moving the wedge element into or out of the adapter member. In the area cooperating with the wedge element, the adapter member may here be provided with slots which subdivide the adapter piece into a plurality of lugs.

The rotor axle should be supported in the upper portion via a radial bearing and in the lower portion via an axial/radial bearing on the substructure.

Embodiments of the invention are illustrated in the drawing and will be explained hereafter.

Figure 1:
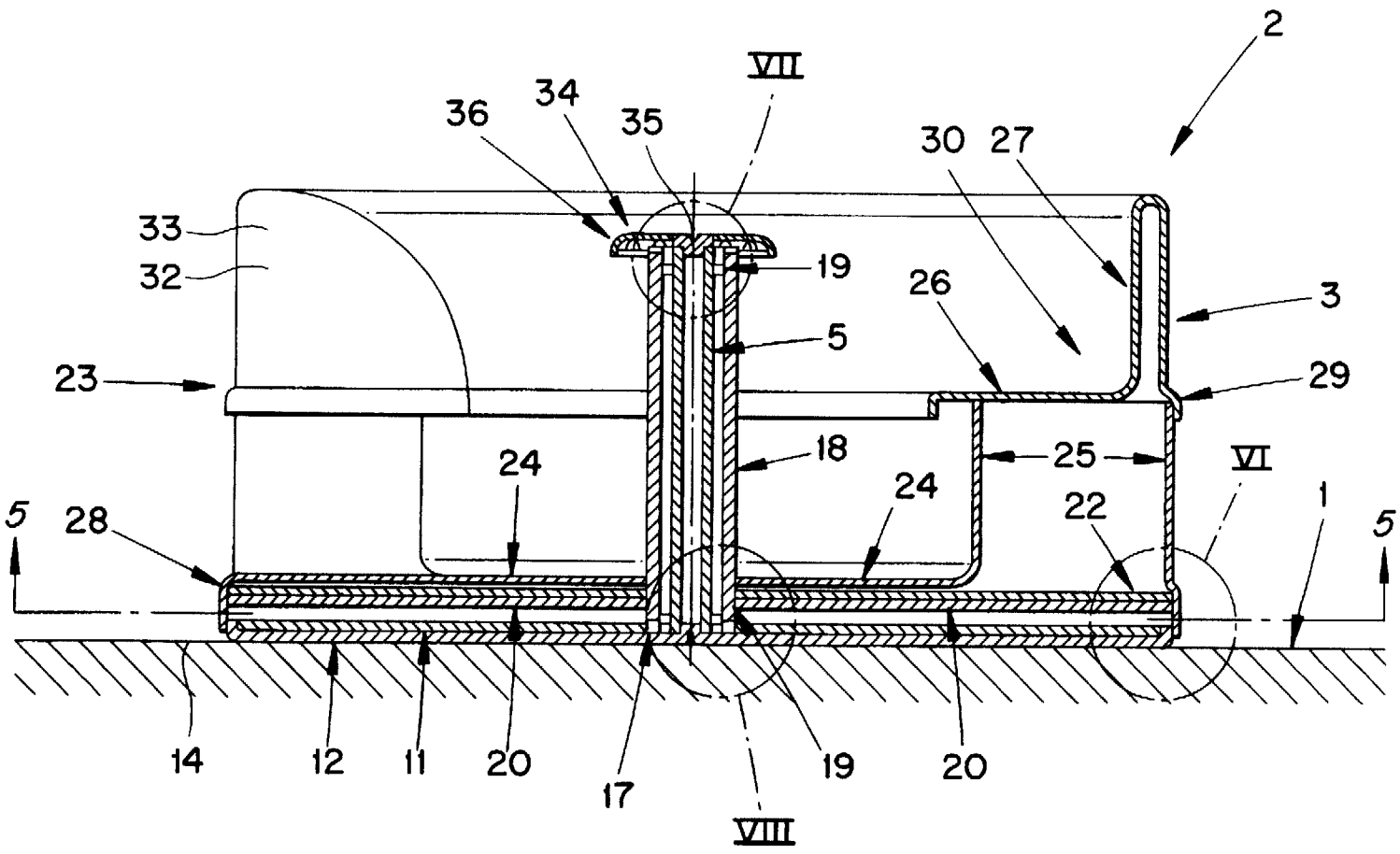
FIG. 1 is a vertical section through a carousel of the invention along cutting line 1—1 in FIG. 2.
Figure 2:
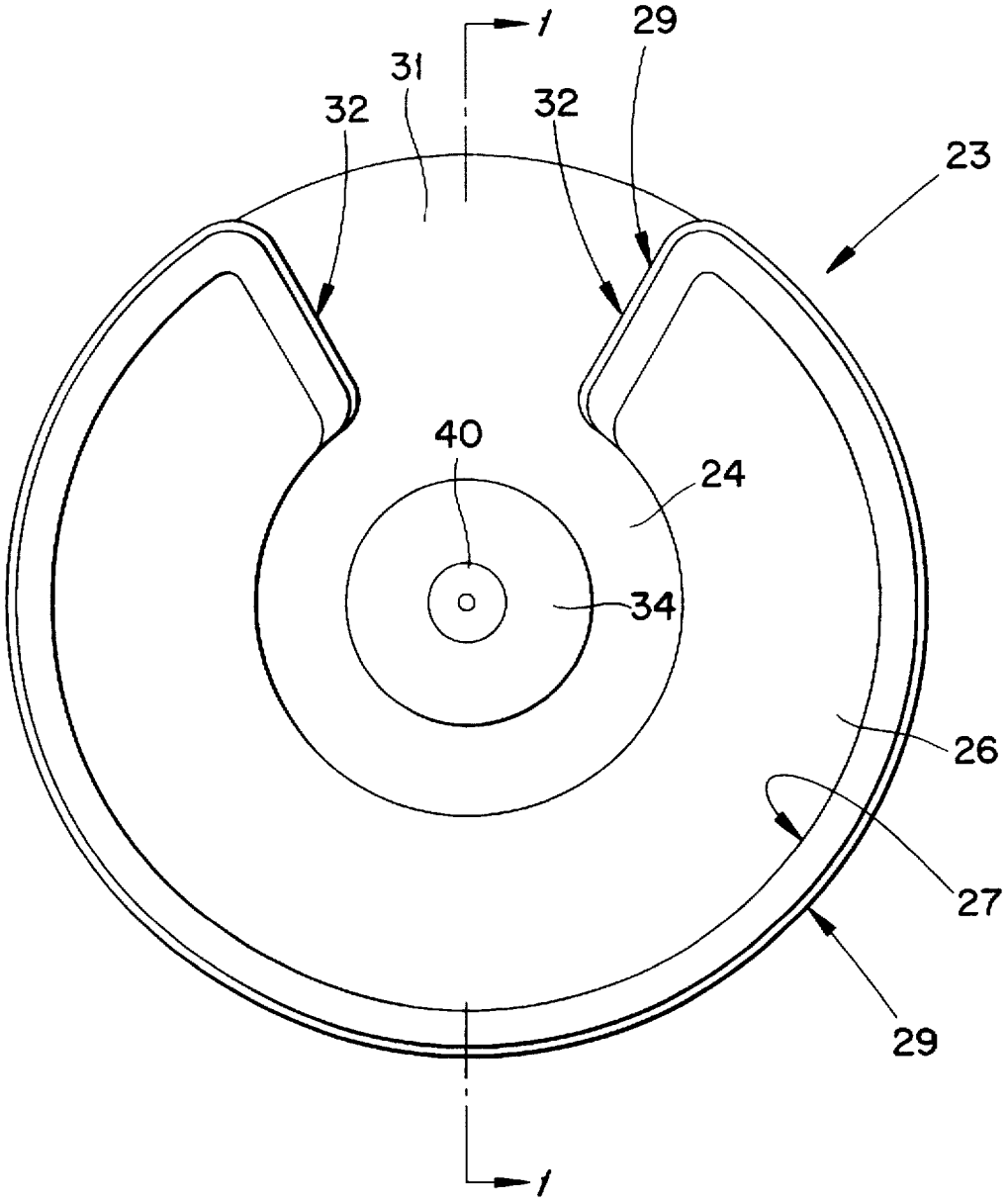
FIG. 2 is a top view on a carousel of the invention.
Figure 3:
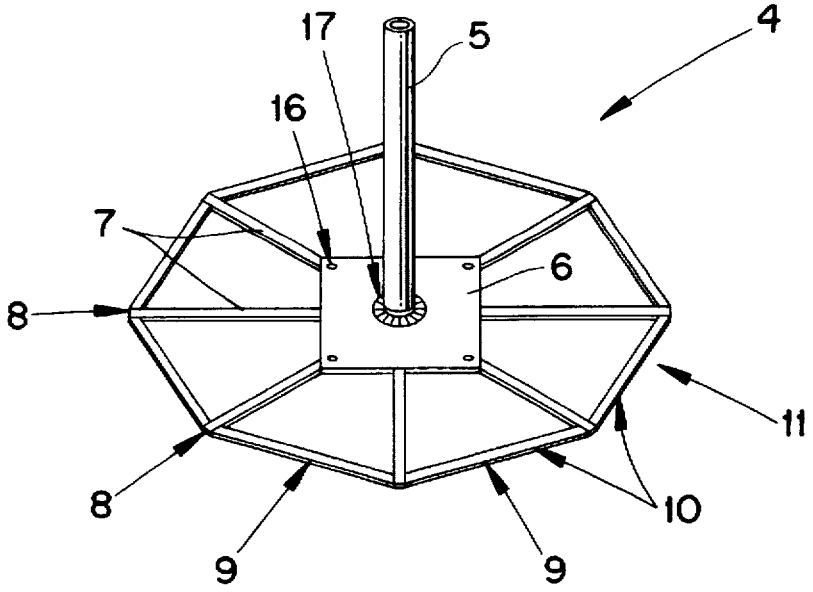
FIG. 3 is a perspective view of a base with a stator axle arranged perpendicular thereto.
Figure 4:
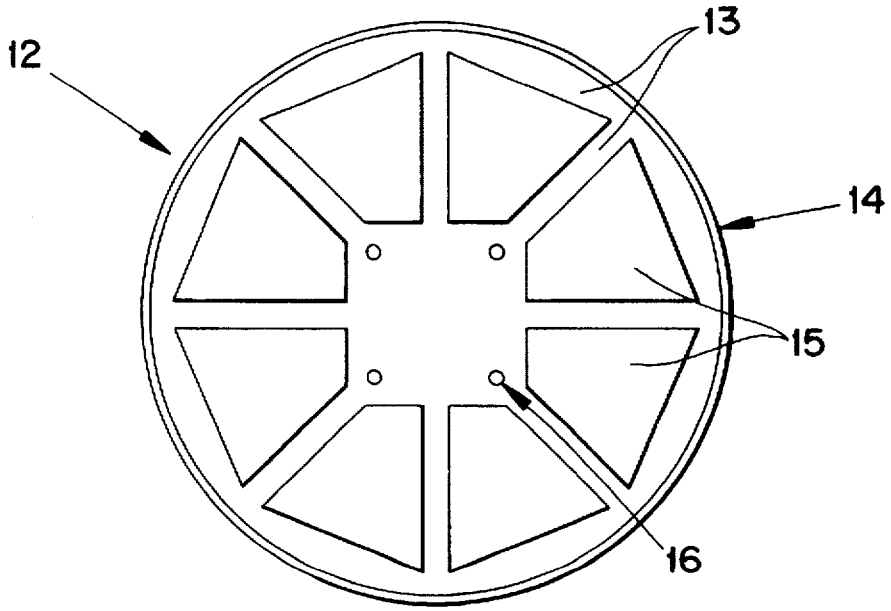
FIG. 4 is a top view on a ground plate with recesses formed therein.
Figure 5:
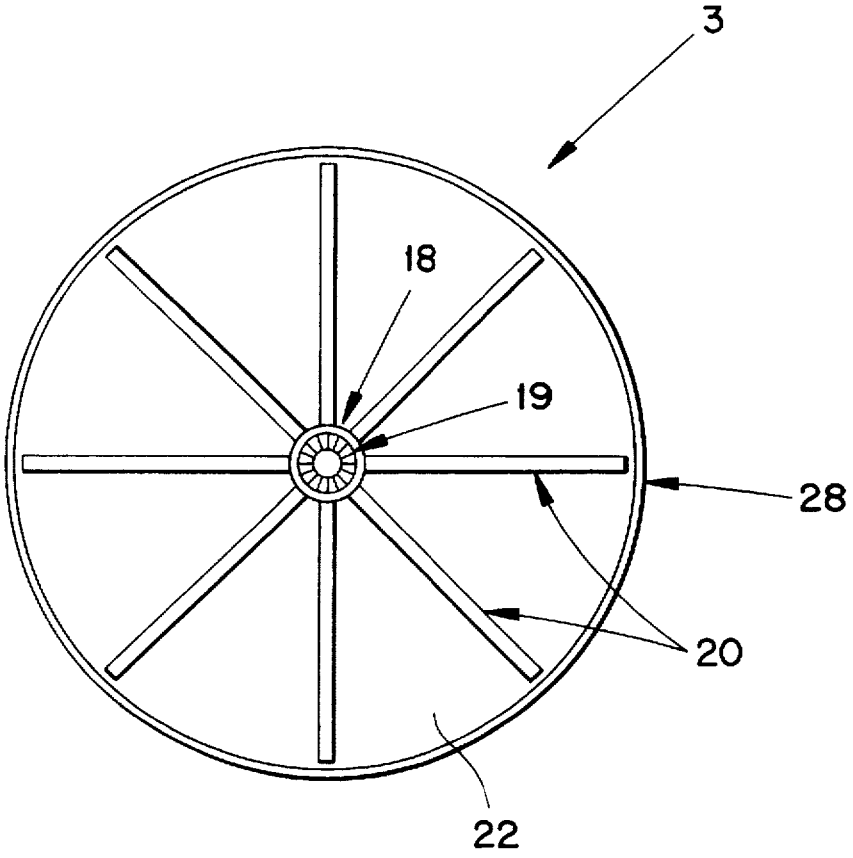
FIG. 5 is a bottom view of the turning section according to the view of cutting line 5—5 in FIG. 1 with radial supports arranged in star-shaped configuration around the rotor axle.

The drawing shows a carousel 2 installed on ground 1, which consists of a rotor 3 and a substructure 4. Substructure 4 comprises a stator axle 5 which is arranged perpendicular to ground 1 and to a base plate 6. In the a real center of base plate 6, stator axle 5 is fixedly welded with its bottom end. Eight radial struts whose ends 8 are disposed approximately along a circular path extend in star-shaped configuration from base plate 6. The ends of two adjacent radial struts 7 are respectively interconnected by a transverse strut 9. All of the transverse struts form together a circumferential traverse. The base plate 6 as well as the radial struts 7 are approximately arranged in one plane, jointly forming a radial support star 11.

A profiled ground plate 12 is arranged between the radial support star 11 and ground 1. Ground plate 12 has a circular outer contour and includes recesses 13 arranged to correspond to the shape of the radial support star 11. On its circumference, ground plate 12 has a circumferential edge 14 oriented away from ground 1. Elevations 15 are formed between recesses 13.

In the area of each of its corners, base plate 6 has a hole 16 with respect to which a hole 16 is provided in ground plate 12 to correspond thereto. An axial needle bearing 17 is inserted in base plate 6 to be concentric around the stator axle.

The transverse struts 9, the radial struts 7 and the base plate 6 are made from individual parts and welded together. The transverse struts 9 and the radial struts 7 are made from a rectangular steel tube having cross-sectional dimensions 30×20 mm at a wall thickness of 2 mm. The stator axle consists of a steel tube having the cross-sectional dimensions Ø 40×7 mm. The base plate has the dimensions 400×400×20 mm.

The rotor has a rotor tube 18 arranged coaxial to the stator axle 5. Rotor tube 18 consists of a steel tube having the dimensions Ø 100×10 mm. The rotor tube 18 is supported on the stator axle 5 via two radial bearings 19 and an axial bearing 17. The radial bearings 19 are formed as deep-groove ball bearings. They are spaced apart from one another to a considerable extent so that one radial bearing 19 is arranged as much as possible away from ground 1 in the upper portion of rotor tube 18 and the other radial bearing 19 is disposed near ground 1 in the lower portion of rotor tube 18. Rotor tube 18 is supported with its face on the axial bearing 17 inserted into base plate 6. As a result, rotor tube 18 is supported in an axially unmovable manner but is coaxially rotatable about the stator axle 5. The axial bearing 17 and the lower radial bearing may preferably be combined in a combinatory axial/radial bearing. The stator axle 5 projects with its upper end slightly from rotor tube 18.

Radial supports 20 are welded in star-shaped configuration to the rotor tube 18 in the lower portion. A circular stiffening plate 22 is secured to the radial supports 20 at the side facing a way from ground 1. The stiffening plate 22 may be adhesively secured, riveted or fixedly screwed to the radial supports 20. Rotor tube 18 passes through the center of the circular stiffening plate 22.

The turning section 23 for carrying people is located on stiffening plate 22. The turning section 23 has a bipartite structure and includes a bearing plate 24 including bench carrier 25 and a bench shell 26 with backrest 27. The bearing plate 24 extends in parallel with stiffening plate 22 and is adhesively secured thereto. The turning section 23 is circumferentially provided with a skirting 28 which externally grips over stiffening plate 22 with radial supports 20.

The bench shell 26 is mounted together with backrest 27 on bench carriers 25. The bench shell has a shoulder 29 which extends in the circumferential direction of turning section 24 and grips over the bench carrier 25 on the outside. As a result, the bench shell 26 is radially undisplaceable relative to bench carrier 25. The bench shell 26 is additionally glued to bench carrier 25. Bearing plate 24 with bench carrier 25 and bench shell 26 with backrest 27 are each formed as plastic deep-drawn parts.

Bench carrier 25 and bench shell 26 with backrest 27 jointly form a bench 30 which is circularly arranged around rotor tube 18 to face the same. The circular bench 30 is interrupted by a sector-like entrance opening 31. The backrest 27 is partly continued as a side rest 33 in the lateral portions 32 of the entrance opening. Shoulder 29 is also continued in the lateral portions 32 in radial direction.

A hand wheel 34 is arranged at the upper end of stator axle 5 which faces away from ground 1. Hand wheel 34 is connected via an adapter member 35 to the face of stator axle 5. Hand wheel 34 extends substantially in a direction perpendicular to stator axle 5. It is substantially made circular and has an edge 36 directed towards ground 1. Edge 36 has indentations 41 distributed over the circumference so that hand wheel 34 assumes, on the whole, the shape of a crown cap. At the side facing ground 1, edge 36 is terminated by a continuous surrounding circular edge 42. Hand wheel 34 is formed as a plastic deep-drawn part.

Figure 6:
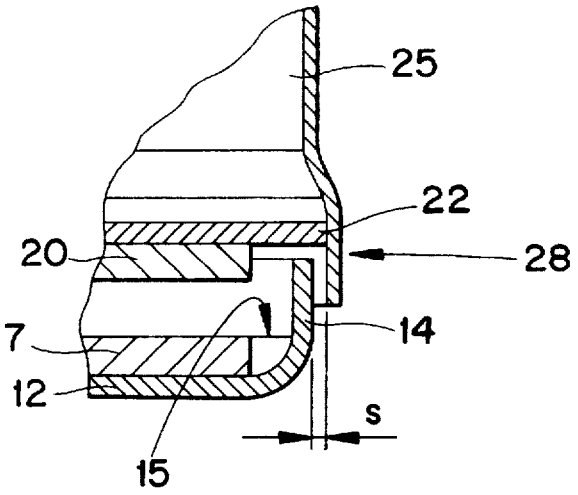
FIG. 6 shows detail VI of FIG. 1 on an enlarged scale.

In FIG. 6 skirting 28 of turning section 23 overlaps the circumferential edge 15 of ground plate 12. Circumferential edge 14 and skirting 28 are spaced apart from each other by a gap s. Gap s is not more than 3 mm in the unloaded state of the turning section and also in the loaded state thereof, i.e. when turning section 23 is occupied by people.

Figure 7:
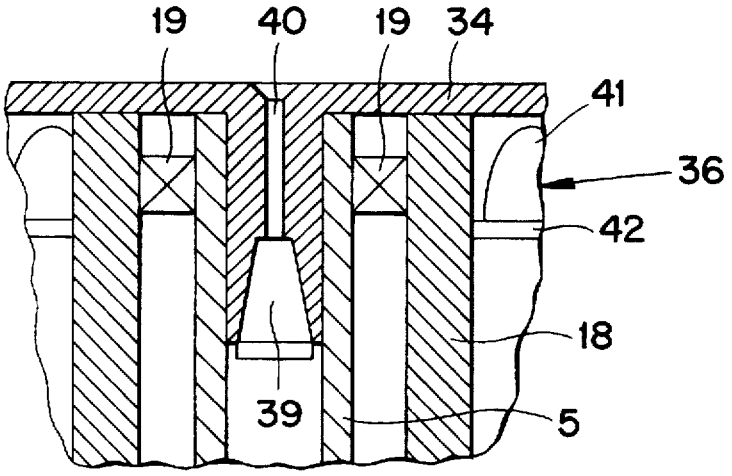
FIG. 7 shows detail VII of FIG. 1 on an enlarged scale.
Figure 8:
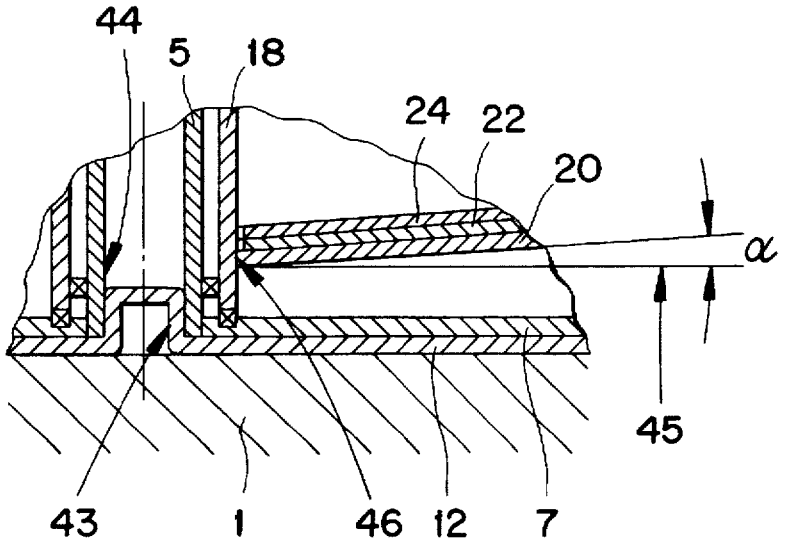
FIG. 8 shows detail VIII of FIG. 1 on an enlarged scale.
Figure 9:
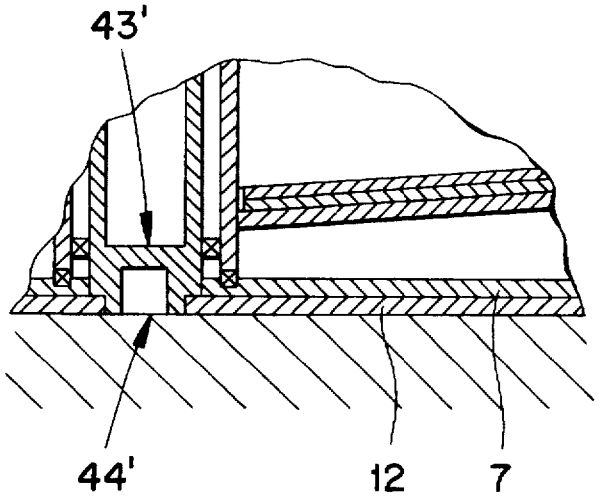
FIG. 9 shows another embodiment of the present invention.

FIG. 7 shows an embodiment of a limit-torque release means 38. The means comprises a wedge element 39 which is arranged within the stator axle 5 and disposed in the lower end of adapter member 35, the end being shaped as a hollow cone. An adjusting means which is formed as a screw 40 extends through the adapter member 35. Screw 40 is screwed into wedge element 39 and is supported on hand wheel 34 via its head. The wedge element 39 can be displaced axially within stator axle 5 by turning screw 40. The lower end of adapter member 35 is expanded accordingly by displacing wedge element 39 and is pressed against the inner wall of stator axle 5. FIG. 8 shows the elements for defining the position of ground plate 12 on substructure 4. Ground plate 12 has a centering bolt 43 which is arranged coaxial to stator axle 5 and molded into the ground plate 12 as a projection. The centering bolt 43 positively engages into a central receiving portion 44 at the bottom end of stator axle 5. Ground plate 12 is thereby centered in radial direction on substructure 4. According to another embodiment, illustrated in FIG. 9, a centering shoulder 43' is provided on the radial support star 11, and a central receiving portion 44' is provided on the ground plate 12.

The radial supports 20 which support turning section 23 are welded to rotor axle 18 at an attachment point 46. A horizontal plane 45 which extends in parallel with ground 1 is drawn through attachment point 46. The radial supports are arranged relative to the horizontal plane 35 at an angle $\alpha$ upwardly, i.e. away from the ground. The stiffening plate 25 and bearing plate 24 are arranged thereabove accordingly. Angle $\alpha$ is 2°.

All of the outwardly oriented edges of turning section 23 are made round with relatively large rounding radii to prevent injuries.

We claim:

1. A carousel for people, especially children, comprising a substructure which is stationary relative to a ground and which has a stator axle essentially perpendicular to said ground and a radial support star essentially parallel to said ground, and a rotor being rotatable about said stator axle and having a turning section for carrying people, wherein said radial support star is located on a profiled ground plate in recesses thereof that essentially conform to the shape of said radial support star.

2. A carousel according to claim 1, wherein said ground plate is made circular and is gripped over by a skirting of said turning section circumferentially at least to some extent.

3. A carousel according to claim 2, wherein the height of said skirting corresponds at least to the height difference of said radial supports between fully loaded rotor and unloaded rotor.

4. A carousel according to claim 2 wherein said ground plate comprises a circumferential edge, and wherein the clearance between said circumferential edge and said skirting is not more than 3 mm in the loaded and unloaded state of said rotor.

5. A carousel according to claim 1, wherein said ground plate is circumferentially provided with a circumferential edge oriented towards said turning section.

6. A carousel according to claim 1, wherein said rotor comprises radial supports which support said turning section and which, enclosing an angle ($\alpha$) with a horizontal plane, are arranged in an upwardly directed manner.

7. A carousel according to claim 6, wherein said angle ($\alpha$) is 1° to 5°.

8. A carousel according to claim 6, wherein said angle ($\alpha$) is about 2°.

9. A carousel according to claim 6, wherein said angle ($\alpha$) is dimensioned such that in the fully loaded state of said turning section said radial supports are arranged above said horizontal plane containing their respective attachment point on a rotor axle.

10.A carousel according to claim 9, wherein said rotor axle is supported in the upper area above a radial support and in the lower area via an axial/radial bearing on said substructure.

11. A carousel according to claim 6, wherein a hand wheel is provided at the upper end of said stator axle.

12. A carousel according to claim 11, wherein said hand wheel has a surrounding edge oriented towards ground.

13. A carousel according to claim 12, wherein said surrounding edge is circumferentially provided with indentations.

14. A carousel according to claim 12, wherein said surrounding edge is terminated at the bottom side by a continuously surrounding circular edge.

15. A carousel according to claim 11, wherein said hand wheel has substantially the shape of a crown cap.

16. A carousel according to claim 11, wherein said substructure and said rotor are interconnected via a speed limiting means.

17. A carousel according to claim 16, wherein said speed limiting means is formed as a viscous coupling.

18. A carousel according to claim 16, wherein said speed limiting means is coupled to said hand wheel.

19. A carousel according to claim 11, wherein said hand wheel is connected to said stator axle via a limit-torque release means.

20. A carousel according to claim 19, wherein said limit-torque release means comprises a wedge element which expands said adapter member projecting into said stator axle, at least in portions, for frictional contact with said substructure.

21. A carousel according to claim 19, wherein the limit torque of said limit-torque release means is adjustable via an adjusting means.

22. A carousel according to claim 11, wherein said hand wheel is connected to said stator axle via an adapter member.

23. A carousel according to claim 1, wherein said radial support star comprises a central centering shoulder and said ground plate comprises a central receiving portion aligned to engage with said central centering shoulder.

24. A carousel according to claim 1, wherein said ground plate comprises a central centering shoulder and said radial support star comprises a central receiving portion aligned to engage with said central centering shoulder.

25. A carousel according to claim 24, wherein said centering shoulder is designed as a centering bolt formed into said ground plate.

* * * * *